US006533004B1

(12) United States Patent
Thor

(10) Patent No.: US 6,533,004 B1
(45) Date of Patent: Mar. 18, 2003

(54) WOOD-SPLITTING TOOL

(76) Inventor: Harris G. Thor, 400 Bunn Hill Rd., Vestal, NY (US) 13850

( * ) Notice: Subject to any disclaimer, the term of this patent is extended or adjusted under 35 U.S.C. 154(b) by 0 days.

(21) Appl. No.: 10/059,069

(22) Filed: Jan. 30, 2002

(51) Int. Cl.[7] ..... B27L 7/00

(52) U.S. Cl. ..... 144/195.7; 144/195.5; 144/195.8; 254/104

(58) Field of Search ..... 144/193.1, 195.5, 144/195.7, 195.8, 366; 254/104

(56) References Cited

U.S. PATENT DOCUMENTS

| | | | | |
|---|---|---|---|---|
| 443,581 A | * | 12/1890 | Marshall | 144/195.8 |
| 4,194,544 A | * | 3/1980 | Scott et al. | 254/104 |
| 4,294,298 A | * | 10/1981 | Otte, Jr. | 144/195.5 |
| 4,387,753 A | * | 6/1983 | Reynolds | 254/104 |
| 4,470,440 A | * | 9/1984 | Thor | 144/195.5 |
| 4,730,653 A | * | 3/1988 | Pantone et al. | 144/195.5 |
| 5,690,316 A | * | 11/1997 | Madjarac | 254/104 |

FOREIGN PATENT DOCUMENTS

| | | | |
|---|---|---|---|
| DE | 44558 | * 10/1927 | 254/104 |
| DE | 633270 | * 7/1936 | 144/195.7 |

* cited by examiner

*Primary Examiner*—W. Donald Bray
(74) *Attorney, Agent, or Firm*—Salzman & Levy

(57) ABSTRACT

A wood-splitting impact tool with an enhanced wood-splitting function by virtue of its improved penetration and its reduced recoil. Improving the penetration of the wedge is achieved by fabricating the wedge of aluminum, titanium, graphite composite or alloys thereof, or any lightweight material that has rare energy transfer capability. Penetration into wood is further enhanced by using a frictionless or smooth surface coating on the penetrating surfaces of the wedge, such coating being PTFE, Teflon®, or anodized aluminum. The wedge and its cutting edge surfaces can be anodized to toughen as well as smooth all surfaces subject to deformation. The surface of the wedge is structurally decreased in recoil by interrupting the metal surface with small, periodic, directional or stepped abutments.

7 Claims, 2 Drawing Sheets

WOOD-SPLITTING TOOL

RELATED UNITED STATES PATENT

This application is related to the IMPACT PRODUCING TOOL, which is the subject of U.S. Pat. No. 4,470,440, issued to Harry A. Thor on Sep. 11, 1984.

FIELD OF THE INVENTION

The invention relates to an impact wood-splitting tool and, more particularly, to an improved impact tool that has a wood penetrating wedge featuring a reduced recoil surface.

BACKGROUND OF THE INVENTION

The present invention is related to the impact wood-splitting tool described and illustrated in the aforementioned patent. The impact tool of the patent comprises a shaft having a handle on a proximal end and a wood-splitting wedge on its distal end. The wedge of the tool is positioned upon a piece of wood that is to be split. A weighted hammer surrounds the shaft, and is movably disposed thereupon. The user of the tool uses one hand to slide the hammer downwardly into contact with the wedge, while using the other hand to hold the handle portion in order to keep the shaft upright. The top portion of the wedge is hollow, so that the shaft extends into the wedge and rests upon a blind abutment. A coiled spring surrounds the section of the shaft disposed in the hollow portion of the wedge. The spring is secured within this hollow portion by means of a retaining ring disposed at the top of the hollow section.

The wood is caused to split after one or more thrusts of the weighted hammer against the wedge. The coiled spring operates as an energy transfer mechanism and reduces the recoil of the weighted hammer as it strikes the wedge. The biased hammer strike allows more of the kinetic energy of the hammer to flow into the wedge. As a result of the improved energy transfer, the wedge splits the wood in fewer thrusts of the hammer. Moreover, since the coiled spring effectively disconnects the shaft from the struck wedge, the longevity of the tool itself is enhanced.

Over the years, it has become apparent that there is occasion for certain conditions within a log, such as elasticity and lubricity, to cause the wedge to withdraw from the log after each impact of the hammer. This withdrawal, sometimes referred to as "bounce", can impede the splitting process. One possible way to prevent the wedge from bouncing out of the log is to incorporate a damping unit as part of the hammer in the form of chambers filled with loose lead shot and oil, also referred to as a "dead blow" system. This, however, would increase the cost of the tool appreciably.

The present invention reflects the discovery that one can inexpensively eliminate bounce by manipulating the friction of the wedge. The wedge can be fashioned with a frictional duality. It can be made to more easily penetrate past the wood on its downward movement, but have appreciable friction moving upwardly against the wood in recoil, thus eliminating bounce.

The current invention includes a new wedge whose surface may be coated with a friction-reducing coating, such as PTFE (poly-tetra-fluoro-ethylene) or Teflon®, in order to improve its movement past the wood surface during penetration. The surface of the wedge is structurally decreased in recoil by interrupting the metal surface with a plurality of small, periodic, directional or stepped abutments. The abutments catch or snag the surface of the wood when the wedge is caused to move upwardly, similar to the barb of a fishing-hook, which snags the fish after it penetrates its tissue.

In another embodiment of the invention, the wedge can be fabricated from aluminum, whose soft cutting surface can be anodize hardened to prevent deformation. Aluminum is an ideal material for a splitting wedge because of its low mass, which improves transfer of the impact energy of the hammer to wood. The improved energy transfer increases splitting by at least a third. Anodizing also provides an extremely smooth wedge surface that improves penetration into the wood.

DISCUSSION OF RELATED ART

U.S. Pat. No. 4,194,544, issued to Scott et al. on Mar. 25, 1980 for SPLITTING DEVICE, describes an elongated cone or splitting wedge having a pointed end and a relatively large blunt end with the intermediate portion flaring outwardly from the pointed end to the blunt end. Serrations are formed in the member adjacent the pointed end. The device is gripped by the user, who thrusts it into a log and then strikes the device with a separate driving maul.

SUMMARY OF THE INVENTION

In accordance with the present invention, a wood-splitting impact tool enhances the wood-splitting function by virtue of its improved penetration and its reduced recoil. Improving the penetration of the wedge is achieved by fabricating the wedge of aluminum. Aluminum has rare energy transfer capability, as evidenced by the ball driving capability of aluminum baseball bats. Penetration into wood is also enhanced by using a frictionless or smooth surface coating on the penetrating surfaces of the wedge, such as PTFE, Teflon®, or anodizing the aluminum. Aluminum being softer than steel, its sharp edge and point of impact tend to deform more easily over time. Cutting edge surfaces and can be anodized or "hard coated" to toughen as well as smooth these surfaces.

The surface of the wedge is structurally decreased in recoil by interrupting the metal surface with a plurality of small, periodic, barbed or stepped abutments. The abutments catch and/or snag the surface of the wood when the wedge is caused to move upwardly, similar to the barb of a fishing-hook, which snags the fish after it penetrates its tissue.

It is an object of this invention to provide an improved wood-splitting impact tool.

It is another object of the present invention to provide an impact tool for splitting wood, which has a unique duality: improved penetration and decreased recoil.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, the invention features a wood-splitting impact tool that enhances the wood-splitting function by virtue of its improved penetration and its reduced recoil. Improving the penetration of the wedge is achieved by fabricating the wedge of aluminum, which has rare energy transfer capability. Penetration into wood is further enhanced by using a frictionless or smooth surface coating on the penetrating surfaces of the wedge, such as PTFE, Teflon®, or anodizing the aluminum. Cutting edge surfaces can be anodized to toughen as well as smooth these surfaces. The surface of the wedge is structurally decreased in recoil by interrupting the metal surface with small, periodic, directional stepped abutments. The abutments catch and/or snag the surface of the wood when the wedge is caused to move upwardly.

Figure 1:
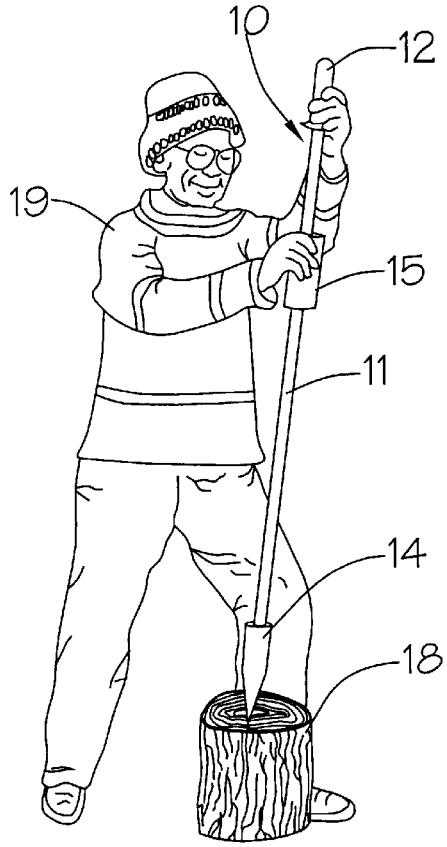
FIG. 1 illustrates an in situ perspective view of the wood-splitting impact tool of this invention.
Figure 2:
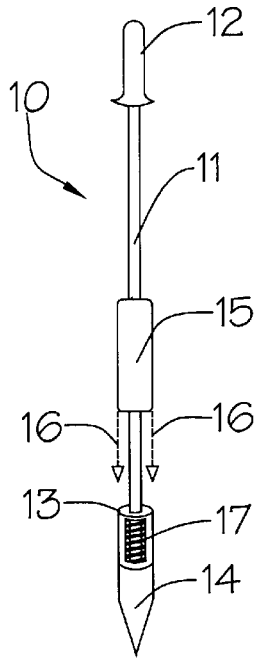
FIG. 2 depicts a front view of the wood-splitting impact tool illustrated in FIG. 1.

Now referring to FIGS. 1 and 2, the wood-splitting impact tool 10 of this invention is illustrated. The impact tool 10 comprises an elongated shaft 11 having a handle portion 12 on its upper, proximal end and a wood-splitting, penetrating wedge 14 on its lower, distal end. A weighted hammer 15 is slidable along the shaft 11, as shown by arrows 16 (FIG. 2).

In operation, the penetrating wedge 14 of the wood-splitting impact tool 10 is placed upon a portion of a log 18 that is to be split. The individual 19 grips the tool 10 about its handle portion 12 with one hand, while with the other hand he grips and thrusts the weighted hammer 15 downwardly (arrows 16) towards the penetrating wedge 14 disposed on top of the log 18. The log 18 will be split after one or more thrusts of the hammer 15. The impact tool 10 has an internal spring 17 that makes more efficient the transfer of kinetic energy of the hammer 15 into the penetrating wedge 14.

Figure 5:
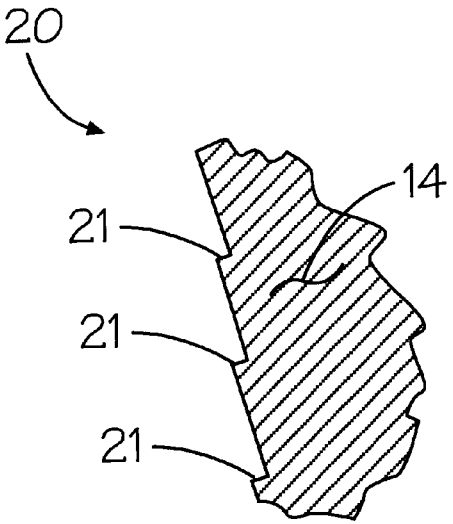
FIG. 5 depicts an enlarged, detailed view of the penetrating surface of the improved wood-splitting wedge shown in FIGS. 3 and 4.
Figure 4:
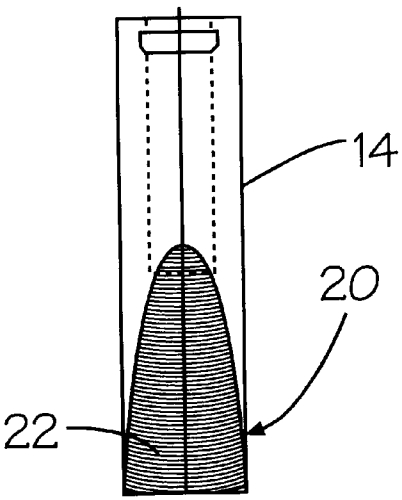
FIG. 4 illustrates a side view of the improved wood-splitting wedge shown in FIG. 3.
Figure 3:
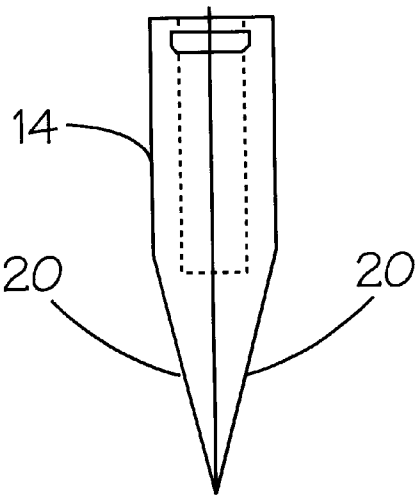
FIG. 3 shows a front view of the improved wood-splitting wedge used in the impact tool depicted in FIGS. 1 and 2.

Referring to FIGS. 3 through 5, an improved penetrating wedge 14 is illustrated. The improved wedge 14 has two oppositely disposed penetrating wedge surfaces 20 that comprise a plurality of stepped abutments 21, as shown in the enlarged, detailed view of FIG. 5. The penetrating surfaces 20 disposed upon both sides of the wedge 14 are structurally decreased in recoil by interrupting the metal surfaces with the small, periodic, barbed or stepped abutments 21. Of course, abutments 21 need not be periodically placed in order to accomplish the function of decreasing recoil. The abutments 21 catch and/or snag the opposing surface of the wood (not shown) when the wedge 14 is caused to move upwardly in recoil within the log 18. The stepped abutments 21 of the wedge 14 can be milled into the wood-penetrating surfaces 20 using a milling machine, not shown.

The stepped abutments 21 illustrated in FIG. 5 can be fabricated as grooves 22 (FIG. 4). The grooves 22 consist of approximately 0.100 inch run or less, with a 0.020 inch rise.

The wedge 14 itself can be fabricated from 6061 T4 or 7075 aluminum. Any suitable steel, aluminum or alloy with or without titanium or titanium by itself can be used. Similarly, a suitable graphite composite could also be incorporated. The penetrating surfaces 20 can be anodized to add smoothness and to toughen the aluminum against deformation through impact over time. Penetration into wood can be further enhanced by using a frictionless or smooth surface coating on the penetrating surfaces of the wedge 14, such as PTFE or Teflon®. Improving the penetration of the wedge 14 is also achieved by fabricating the wedge of aluminum, which has a rare energy transfer capability and can be "hard coated" with a process as per "MIL-A-8625 Type 3" for example.

The system for retaining the spring 17 in the splitting tip or wedge 14, is specially designed for two purposes. First, it retains the spring assembly 17, and second, it is designed to be removable by the user. A retaining ring groove is located near the hammer struck end of the wedge 14, and a retaining ring 13 is thusly seated to enclose the spring/roll pin/retaining ring system within the confines of the hole located in the wedge 14. The square faces and calculated depth at the top of the groove allow the ring 13 to seat firmly, and helps the system to withstand great pressure from a fully compressed spring 17. The downward sloping angle of the bottom of the groove allows for the retaining ring 13 to be slid downward using a pointed instrument, such as a slotted screwdriver (not shown), and manipulated in such a manner that the ring 13 can be removed intact, which allows for disassembly of the entire system.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A self-contained wood-splitting impact tool comprising a wood-penetrating wedge that is impacted by a slidable hammer, said wood-splitting impact tool having decreased bounce due to said wood-penetrating wedge having directional surfaces that include a plurality of abutments that snag, penetrate, or otherwise contact adjacent wood surfaces in recoil, said abutments diminishing the recoil effect, and wherein said wood-penetrating wedge further comprises means defining a cavity and a spring seated therein and further comprising a retaining ring disposed at the boundary of said cavity, said retaining ring being removable by a user of said wood-splitting impact tool.

2. The wood-splitting impact tool in accordance with claim 1, wherein said plurality of abutments further comprises periodically spaced steps along said directional surfaces thereof.

3. The wood-splitting impact tool in accordance with claim 1, wherein said plurality of abutments are milled with an approximate 0.100 inch run.

4. The wood-splitting impact tool in accordance with claim 1, wherein said plurality of abutments are milled with a run that rises to approximately 0.020 inches.

5. The wood-splitting impact tool in accordance with claim 1, wherein said wood-splitting impact wedge comprises aluminum, and said directional surfaces are anodized, improving penetrating capability and resistance to deformation.

6. The wood-splitting impact tool in accordance with claim 1, wherein said directional surfaces are coated with a frictionless material, improving penetrating capability and resistance to deformation.

7. The wood-splitting impact tool in accordance with claim 1, wherein said retaining ring groove is beveled.

* * * * *